United States Patent [19]

Ellis et al.

[11] 4,354,789

[45] Oct. 19, 1982

[54] METHOD AND APPARATUS FOR TRANSFERRING ENVELOPES

[75] Inventors: James B. Ellis, Palatine; Mieczyslaw J. Lisiecki, Norridge; Stephen Ruderman, Oak Park, all of Ill.

[73] Assignee: AES Technology Systems, Inc., Elk Grove Village, Ill.

[21] Appl. No.: 135,355

[22] Filed: Mar. 31, 1980

[51] Int. Cl.[3] ..... B65G 61/00

[52] U.S. Cl. ..... 414/104; 198/485; 414/330; 414/786

[58] Field of Search ..... 414/104, 330, 786; 198/457, 485, 747

[56] References Cited

U.S. PATENT DOCUMENTS

| | | | |
|---|---|---|---|
| 3,399,788 | 9/1968 | Heywood et al. | 414/330 |
| 3,533,496 | 10/1970 | Atwood | 198/457 |
| 4,219,112 | 8/1980 | Lowenthal | 198/457 X |

FOREIGN PATENT DOCUMENTS

| | | | |
|---|---|---|---|
| 54-102768 | 8/1979 | Japan | 198/747 |
| 908836 | 10/1962 | United Kingdom | 198/485 |

*Primary Examiner*—Leslie J. Paperner

*Attorney, Agent, or Firm*—Dressler, Goldsmith, Shore, Sutker & Milnamow, Ltd.

[57] ABSTRACT

A method and apparatus is provided for transferring a batch of envelopes that have been arranged in face-to-face relationship. The envelopes are transferred in a substantially horizontal plane from a first location to a second location spaced from the first location. The apparatus includes a pair of downwardly depending spaced-apart members which are each adapted to contact the batch of envelopes along the end edges of the envelopes. One of the paddles is adapted to urge a batch along a guide channel from the first position to the second position. The other of the paddles is adapted to urge a batch along the guide channel in the opposite direction from the second position to the first position.

13 Claims, 11 Drawing Figures

402
5C.
410
400
504
422
414
406
420
418
404
438
440
112
128
6A,B.
132
130
162
152
158
160
174
176
137
142
150a
148
168
131
514
138
136
143
164
166
134
122
120
126
200
28
210
194
204
206
212
214
216
220
222

METHOD AND APPARATUS FOR TRANSFERRING ENVELOPES

DESCRIPTION

TECHNICAL FIELD

This invention relates to a method and apparatus for transferring documents in discrete batches between a first document handling apparatus and a second document handling apparatus. More specifically, the invention finds particular application in the field of automated envelope opening systems wherein batches of envelopes are fed into and received from an automatic batch-type envelope opening device.

BACKGROUND OF THE INVENTION

In processing large quantities of documents, such as sealed envelopes which are to be opened, it is desirable to use an automatic batch-type envelope opening apparatus. Where such a batch-type envelope opening apparatus has an envelope infeed or receiving station at a height not convenient for the personnel operating the envelope opening apparatus, it would be desirable to provide a system for feeding the envelopes automatically into the envelope opening apparatus. It would be advantageous to provide such a system so that the envelopes could be placed singly, or in groups, into the system by the operating personnel at a convenient height.

With an automatic envelope loading system, it would be desirable to provide a means for conveying the sealed envelopes in discrete batches to the the required height for supplying the envelope opening apparatus and to provide a means for then transferring the envelope batches at that height, one batch at a time, to the envelope opening apparatus.

It would also be desirable to provide means for transferring batches of opened envelopes from the envelope opening apparatus to a suitable receiving means.

SUMMARY OF THE INVENTION

A method is provided for transferring a discrete batch of envelopes between a first holding means, such as may be part of an envelope infeed apparatus, and a second holding means, such as may be part of an envelope opening apparatus. The first and second holding means each have a pair of spaced-apart holding members for receiving the batch of envelopes.

The envelopes are placed and aligned in the first holding means in face-to-face relationship to form a batch between the holding members of the first holding means. A guideway is aligned between the first and second holding means to present a guide surface for guiding at least the bottom edges of the envelopes in the batch. Preferably the guide surface is parallel to the plane of the bottom edges of the envelopes in the first holding means. Next the batch of envelopes is urged from the first holding means to move along the guide surface to the second holding means. The movement of the batch is terminated when the envelopes are positioned between the spaced-apart holding members of the second holding means.

The apparatus for effecting the above-described method includes, in its preferred form, a frame supporting a guideway having a generally V-shaped guide surface for guiding the bottom edge and one end edge of each of the envelopes in the batch. The apparatus includes a movable assembly having a pair of spaced-apart envelope batch engaging members or paddles. Each paddle has a planar engaging surface disposed in a plane substantially perpendicular to the V-shaped guide surfaces and is adapted to engage one end of the batch of envelopes. The paddles are spaced apart a distance that is greater than the length of the envelopes. The batch can thus be engaged and moved by only one of the paddles at a time. The assembly of the spaced-apart paddles is mounted for reciprocating movement in a direction generally parallel to the guide surfaces between a first position at the first envelope holding means and a second position at the second envelope holding means. A means is provided for moving the assembly of spaced-apart batch engaging paddles together between the two positions to transfer the batch of envelopes between the two positions.

Numerous other advantages and features of the present invention will become readily apparent from the following detailed description of the invention and of one embodiment thereof, from the claims and from the accompanying drawings.

BRIEF DESCRIPTION OF THE DRAWINGS

In the accompanying drawings forming part of the specification, and in which like numerals are employed to designate like parts throughout the same.

DESCRIPTION OF THE PREFERRED EMBODIMENT

Figure 1:
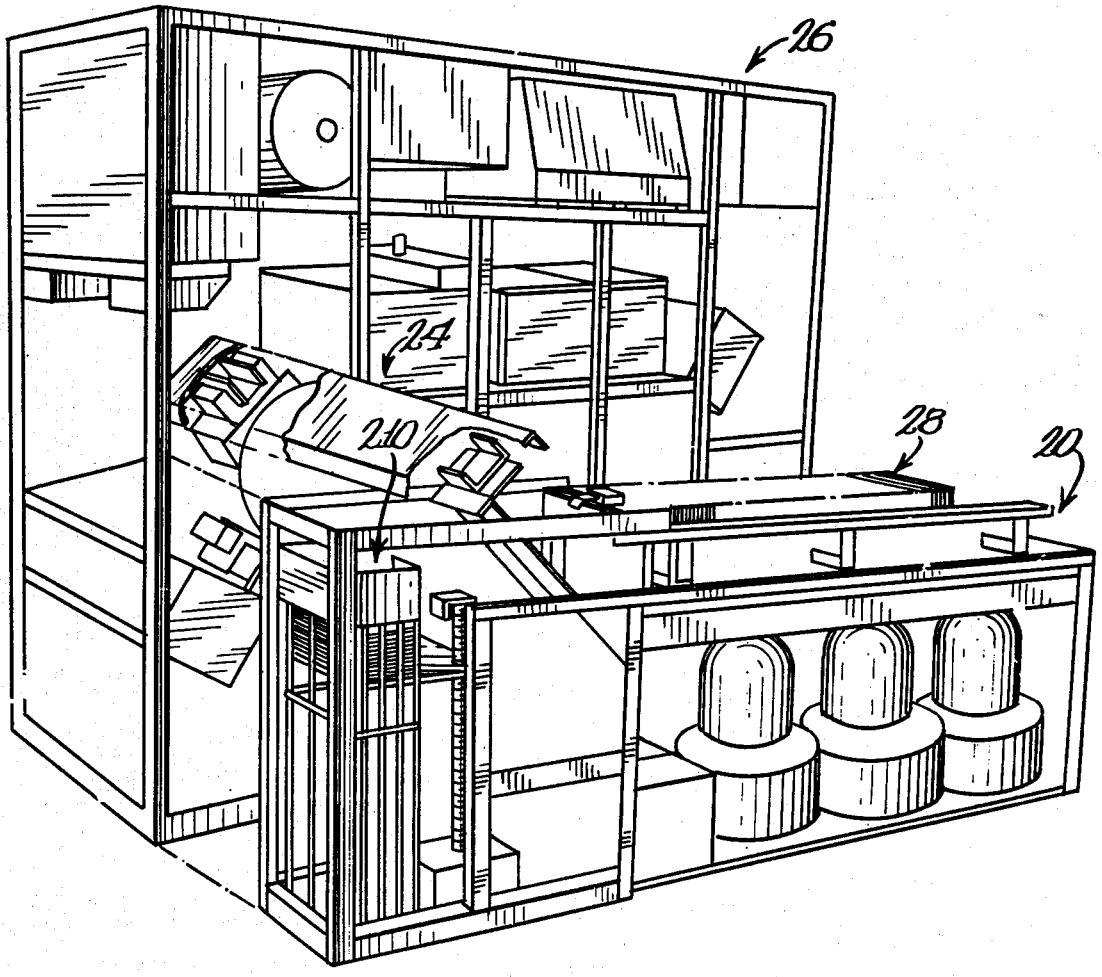
FIG. 1 is a perspective view, with much detail omitted, of the envelope transfer apparatus shown in conjunction with an envelope feeding apparatus and an automatic batch-type envelope opening apparatus.

While this invention is susceptible of embodiment in many different forms, there is shown in the drawings and will herein be described in detail one specific embodiment, with the understanding that the present disclosure is to be considered as an exemplification of the principles of the invention and is not intended to limit the invention to the embodiment illustrated.

The precise shapes and sizes of the components herein described are not essential to the invention unless otherwise indicated, since the invention is described with reference to an illustrative embodiment thereof.

For ease of description, the apparatus will be described herein in a normal operating position, and terms such as upper, lower, horizontal, etc., will be used with reference to this position. It will be understood, however, that the apparatus of this invention may be manufactured, stored, transported, used, and sold in an orientation other than the position described.

The apparatus described herein has certain conventional drive mechanisms and control mechanisms the details of which, though not fully illustrated or described, will be apparent to those having skill in the art and an understanding of the necessary functions of such mechanisms.

The choice of materials used in the construction of the apparatus described herein is dependent upon the particular application involved and other variables, as those skilled in the art will appreciate.

FIG. 1 illustrates an envelope batch transfer apparatus 24 shown operating in conjunction with an envelope feeding apparatus 20 on one side and a batch-type envelope opening apparatus 26 on the other side. The envelope feeding apparatus 20 supplies a plurality of envelopes arranged in discrete batches to the transfer apparatus 24 which then transfers the envelopes, one batch at a time, to the infeed station of the envelope opening apparatus 26.

After the envelope opening apparatus 26 has taken a batch of sealed envelopes from the transfer device 24, the envelope opening apparatus 26 presents a batch of opened envelopes to the transfer device which then carries the batch of opened envelopes back to the envelope feeding apparatus 20. The envelope feeding apparatus 20 carries the batch of opened envelopes to an exit station where the batch is deposited within a suitable receiving means 210.

The envelope feeding apparatus 20 illustrated in FIG. 1 is fully described and illustrated in the concurrently filed patent application entitled, "Method and Apparatus for Feeding Envelopes," Ser. No. 135,354. The envelope opening apparatus 26 illustrated in FIG. 1 is fully described and illustrated in the concurrently filed patent applications entitled "Method and Apparatus for Opening Envelopes," Ser. No. 135,356; "Method and Apparatus for Conveying and Opening Envelopes," Ser. No. 135,326; and "Method and Apparatus for Opening Envelopes With a Chemical Spray," Ser. No. 135,353.

It is to be realized that the envelope batch transfer apparatus 24 illustrated and described herein will function to transfer envelopes in discrete batches at a predetermined elevation between a first holding means on one side and a second holding means on the other side. It is a feature of the envelope batch transfer apparatus 24 to provide a generally horizontal transfer of batches of documents or envelopes quickly and efficiently between two predetermined positions. To accomplish this function between two spaced apart stations, the batch of documents or envelopes is presented at each station between a pair of spaced-apart generally parallel members in face-to-face relationship to form a batch in which the envelopes are substantially aligned along all of the corresponding edges. Further, access is provided on either end of the batch to permit engagement of oppositely facing edge regions of the batch of envelopes by the transfer apparatus 24 as will be explained in more detail hereinafter.

Figures 2, 2A, 2B:
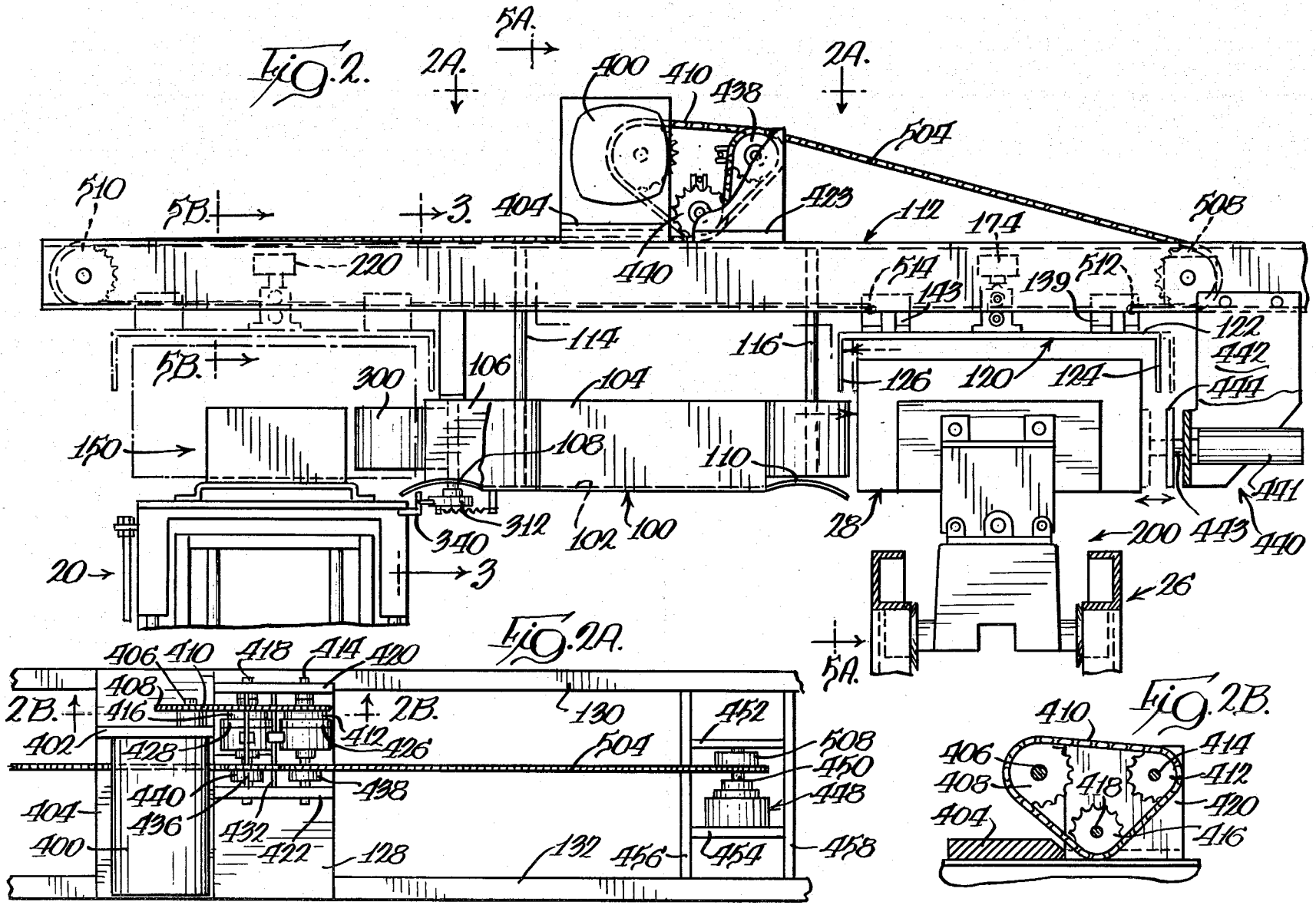
FIG. 2 is an enlarged, fragmentary view of the envelope batch transfer apparatus taken from between the envelope opening apparatus and the envelope feeding apparatus and viewing from above the apparatus in FIG. 1 but at an angle of about 45 degrees from the vertical.
FIG. 2A is a fragmentary view taken generally along the plane 2A—2A in FIG. 2.
FIG. 2B is a fragmentary, cross-sectional view taken generally along the plane 2B—2B in FIG. 2A.

FIG. 2 shows the envelope batch transfer apparatus 24 from the top and positioned, as in FIG. 1, between the envelope infeed apparatus 20 on the left and the envelope batch-type opening apparatus 26 on the right. On the left, the envelopes are arranged in face-to-face relationship in a batch 28 with their edges aligned and are supported in a cradle 150 of the apparatus 20 which is described in detail in the aforementioned concurrently filed patent application entitled "Method and Apparatus for Feeding Envelopes." For purposes of understanding the structure and operation of the envelope batch transfer apparatus 24 described herein, it is merely sufficient to note that the envelopes are provided on the left-hand end of the apparatus 24 (as viewed in FIG. 2) in a batch 28 held between two spaced-apart members at the general position illustrated with respect to the apparatus 24. Similarly, on the right-hand side of the apparatus 24, a batch of envelopes may be transferred to or from an envelope batch holding car 200 which is described and illustrated in more detail in the aforementioned concurrently filed patent application entitled "Method and Apparatus for Opening Envelopes." For purposes of understanding the structure in operation of the envelope batch transfer apparatus 24, it is sufficient to understand that the batch holding car 200 holds the envelopes in face-to-face relationship in a batch with all of the corresponding envelope edges aligned between two spaced-apart members.

Although the transfer apparatus 24 is shown operating in conjunction with the envelope infeed apparatus 20 and envelope opener apparatus 26, it is to be realized that the transfer apparatus 24 may be used between any two stations in which the envelopes are held in face-to-face relationship with the corresponding envelope edges generally aligned in registry and with at least a portion of each end of the envelope batch clear of obstructions to permit the transfer apparatus 24 to engage the batch ends in a manner that will be explained in more detail hereinafter.

The envelope batch transfer apparatus 24 is supported between two work stations by suitable support members (not illustrated). The transfer apparatus 24 may also be supported from either or both of the devices between which it functions to transfer envelopes, such as between the envelope infeed apparatus 20 and the envelope opening apparatus 26 illustrated in FIG. 2.

Figure 3:
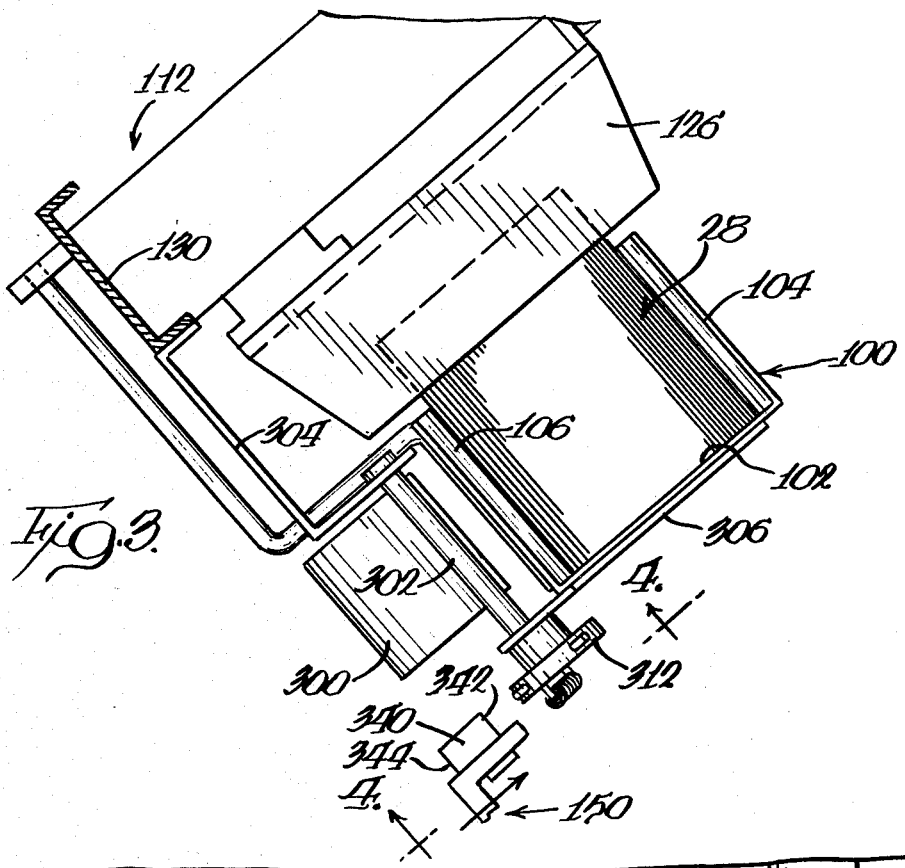
FIG. 3 is an enlarged, fragmentary, cross-sectional view taken generally along the plane 3—3 in FIG. 2.

As best illustrated in FIGS. 2 and 3, the apparatus 24 has a channel-shaped guide 100 having a bottom wall 102 and a pair of opposed sidewalls, front sidewall 104 and rear sidewall 106. At the left-hand end of guide 100 (as viewed in FIG. 2) the bottom wall 102 has an arcuate portion 108 and at the right-hand end of the guide 100 the bottom wall 102 has an arcuate portion 110.

The guide 100 is mounted to an elongate housing 112 by means of a pair of spaced-apart mounting rods 114 and 116.

Figures 5A, 5B, 5C:
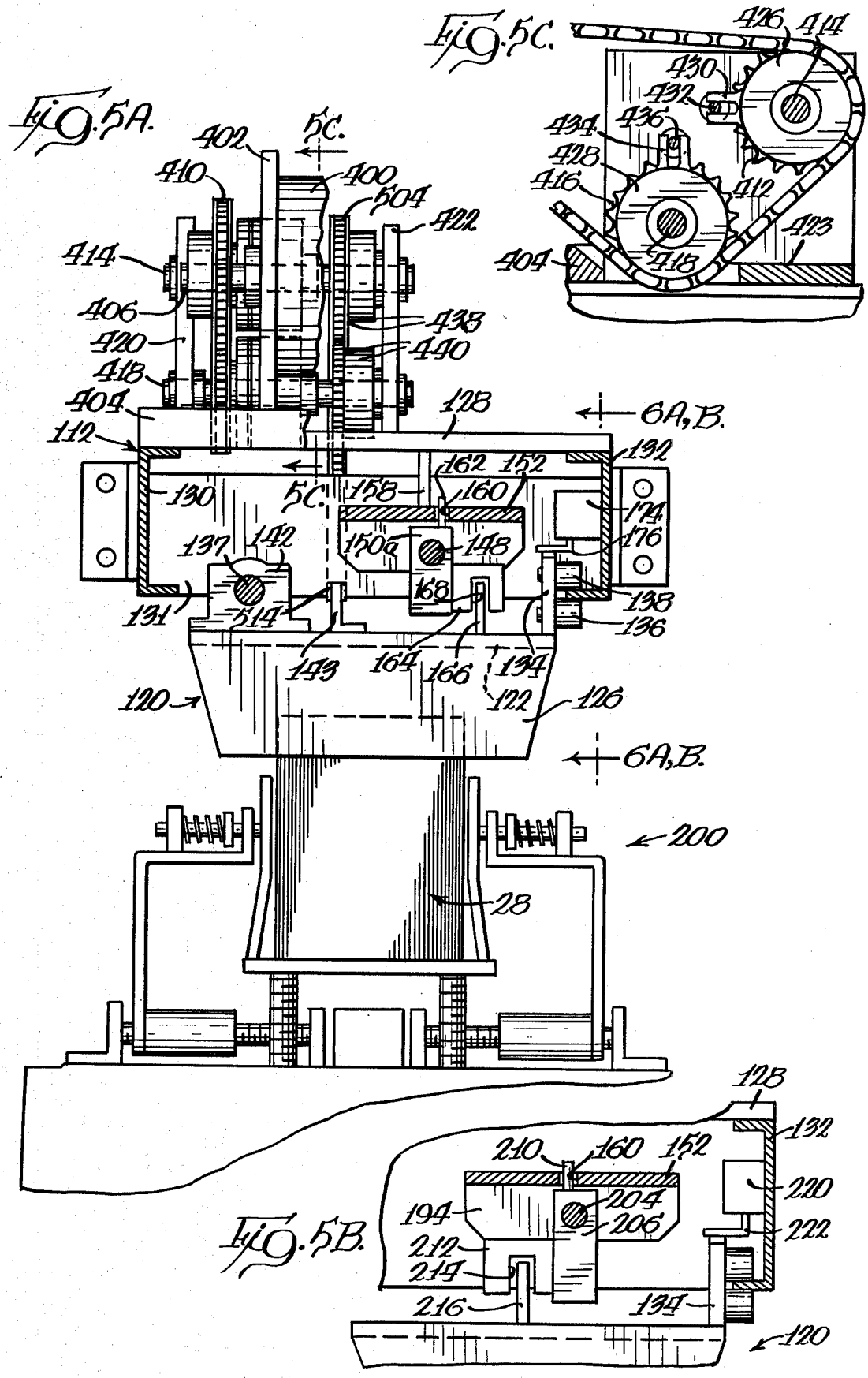
FIG. 5A is an enlarged, fragmentary, cross-sectional view taken generally along the planes 5A—5A in FIG. 2.
FIG. 5B is an enlarged, fragmentary, cross-sectional view taken generally along the plane 5B—5B in FIG. 2.
FIG. 5C is a fragmentary, cross-sectional view taken generally along the plane 5C—5C in FIG. 5A.

The batch of envelopes 28 are moved along the guide by means of a transfer paddle assembly 120. The assembly 120 includes a base member 122 to which are mounted a pair of spaced-apart transfer paddles 124 and 126. The paddles 124 and 126 are disposed in substantially parallel planes and are adapted to engage the end edges of the envelopes in the batch 28. As best shown in FIGS. 3 and 5A for paddle 126, the paddles have a width sufficient to extend to either side of the batch of envelopes 28.

The assembly 120 is mounted for reciprocation within housing 112 as best illustrated in FIG. 5A. Specifically, housing 112 has a member 128 securing a pair of opposing side channels 130 and 132. The base member 122 of the paddle assembly 120 carries an outwardly projecting bracket 134 to which is mounted a pair of spaced apart rollers 136 and 138. The roller 138 rides along the top surface of the horizontal leg of the side channel 132 and the bottom roller 136 rides along the bottom surface of the lower leg of the side channel 132.

Figure 6A:
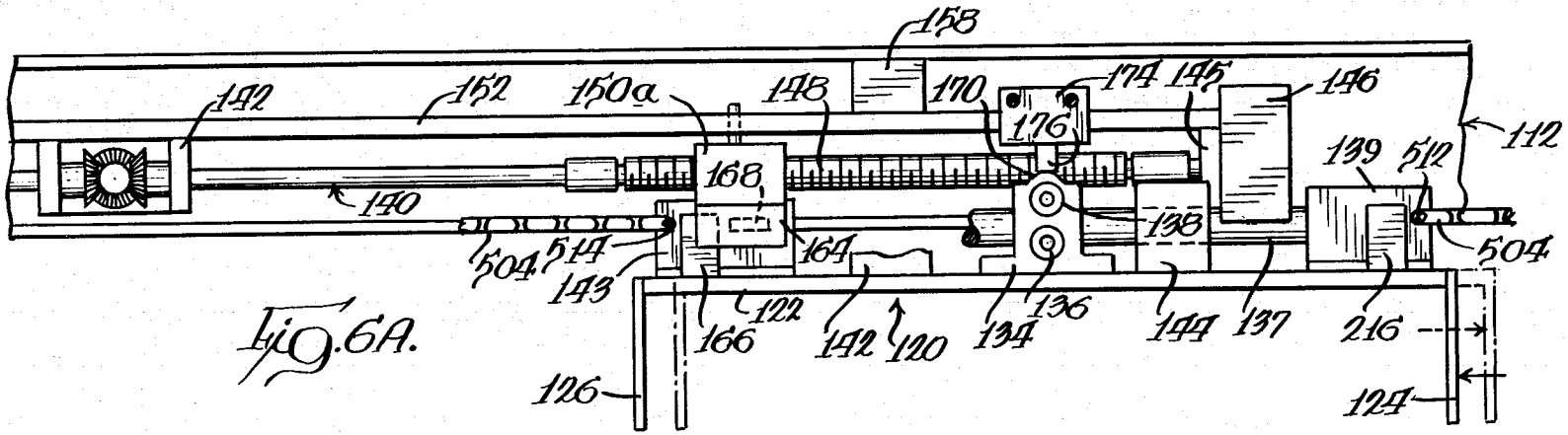
FIGS. 6A and 6B are fragmentary, partial cross-sectional views taken generally along the plane 6A, B-6A, B in FIG. 5 and showing moved positions of the envelope batch transfer apparatus.
Figure 6B:
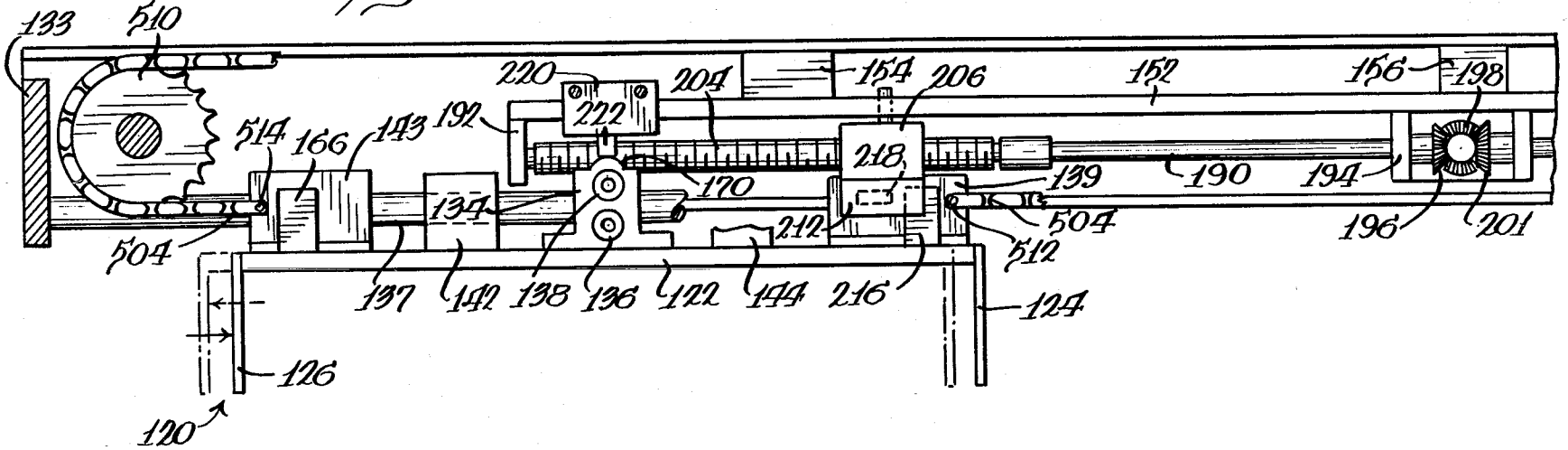

Also, as illustrated in FIGS. 5A, 6A, and 6B, the housing 112 supports a generally horizontally extending cylindrical rod 137. The rod 137 is supported with the housing 112, at the left-hand end as viewed in FIG. 6B, by end plate 133 and at the opposite end by end plate 131 (FIG. 5A). The rod 137 supports the transfer assembly 120 in sliding engagement therewith by means of a pair of spaced apart brackets 142 and 144. Each bracket 142 and 144 has a bore for slidably receiving the rod 137 therein.

The transfer paddle assembly 120 is driven by means of an electric motor 400 as best illustrated in FIGS. 2, 2A, 2B and 5A. The motor 400 is mounted to a vertical support plate 402 fixed to a base plate 404. The motor has a shaft 406 projecting downwardly and carrying a sprocket 408 around which is trained a drive chain 410. As best illustrated in FIG. 2B, the drive chain 410 is also trained around two other sprockets, sprocket 412 on shaft 414 and sprocket 416 on shaft 418. Shafts 414 and 416 are rotatably journalled within outwardly projecting support members 420 and 422 which are mounted to base member 128 as best illustrated in FIG. 2A. The sprockets 412 and 416 are each freely rotatable on the shafts 414 and 418, respectively.

The base member 128 is notched as necessary, as illustrated in FIGS. 2B, 5A, and 5C to accommodate the lowermost sprocket 416.

As best viewed in FIGS. 2A and 5C, the driving portion of an electrically operated clutch 426 is secured to the hub of sprocket 412 on shaft 414 and the driving portion of an electrical clutch 428 is secured to the hub of sprocket 416 on shaft 418.

The housing of clutch 426 has a slotted tab 430 engaged with a fixed rod 432 extending between the support members 420 and 422. Similarly, the housing of clutch 428 has a slotted tab 434 engaged with a fixed rod 436 extending between support members 420 and 422. Each clutch housing is thus prevented from rotating.

The driven portion of clutch 426 is secured to the shaft 414 and the driven portion of clutch 428 is secured to the shaft 418. Thus, when each clutch is separately electrically actuated to engage, the shaft to which it is mounted can be driven through the drive chain 410 by means of the motor 400. The motor 400 is constantly driven in one direction of rotation.

As best illustrated in FIG. 5A a sprocket 438 is secured to the shaft 414 for rotation therewith and a sprocket 440 is secured to shaft 418 for rotation therewith. As best illustrated in FIG. 2, a double-ended drive chain 504 is trained between and partially around the sprockets 438 and 440. Thus, the motor 400 will drive the chain 504 in one direction through sprocket 438 on shaft 414 if the clutch 428 on shaft 418 is disengaged while the clutch 426 on shaft 414 is engaged. This is because the sprocket 416 and the driving portion of clutch 428 on shaft 418 are not secured to shaft 418 which may then be rotated by the chain 504 through sprocket 440. Similarly, the motor 400 will drive the chain 504 in the opposite direction if the clutch 426 on shaft 414 is disengaged while the clutch 428 on shaft 418 is engaged.

When a particular one of the two clutches 426 and 428 is engaged (and the other disengaged) the direction of movement of chain 504 depends, of course, on the direction of rotation of the motor drive shaft 406. The direction of the constant motor rotation is merely a design choice.

Drive chain 504 is directed around the housing 112 by means of idler sprockets 508 and 510. One end of the chain 504 is secured at 512 to a bracket 139 mounted to the back of the base plate 122 of the paddle assembly 120. Similarly, the other end of the chain 504 is secured at 514 to a bracket 143 mounted to the back of base member 122 of the assembly 120.

Engagement of one of the clutches 426 or 428 will thus cause the chain 504 to drive the transfer paddle assembly 120 to one end of the housing 112 and engagement of the other clutch (with disengagement of the first clutch) will cause the chain 504 to drive the transfer paddle assembly 120 to the other end of the housing 112.

A novel arrangement is provided for ensuring complete travel of the transfer paddle assembly 120 to either end of the housing 112 for properly registering the batch of envelopes within the infeed apparatus 20 at one end and within the envelope opening apparatus 26 at the other end. The system includes travel sensing means at each end of the housing 112 as best illustrated in FIGS. 6A and 6B.

With reference to the right-hand end of the housing 112 as illustrated in FIG. 6A, a rod 140 is journalled within a member 142 on the left-hand end. A portion of the rod 140 is threaded at 148 and the distal end is coupled with an electric motor 146 supported on bracket 145 that is mounted to an overlying plate 152. The overlying plate 152 is mounted to the top cover plate 128 of the housing 112 by means of three spaced-apart brackets 154, 156, and 158.

As illustrated in FIGS. 5A and 6A, a limit switch mounting block **150*a* is threadingly engaged on the threaded portion 148 of rod 140 and functions to limit the travel of the transfer paddle assembly 120. The block 150*a* is restrained against rotation on the threaded portion 148 by the overlying plate 152. Specifically, plate 152 defines a longitudinally extending channel 160 in which a lug 162 is disposed as best illustrated in FIG. 5. Lug 162 is secured to the top of the limit switch mounting block 150*a***.

A limit switch 164 is mounted to the side of the limit switch mounting block 150 as best illustrated in FIGS. 5 and 6A. The limit switch 164 is adapted to be actuated by actuator arm 166 mounted to the rear surface of base member 122 of the transfer paddle assembly 120. To this end, limit switch 164 defines therein an actuator receiving channel 168 (FIG. 5A) through which the actuator member 166 may pass to actuate the switch member 168 (shown in dashed line in FIG. 6A). When actuated, the switch 164, acting through a suitable control circuit, disengages both clutches 426 and 428 and further, as will be explained in more detail hereinafter, also applies a drive chain brake and operates an envelope batch bumper.

The location of the limit switch mounting block **150*a*, and hence of the limit switch 164, may be adjusted by the operation of motor 146, through suitable control system, to rotate the rod 140 about its longitudinal axis and thus cause relative displacement of the switch block 150***a* relative to the rod 140. Typically, for a given size envelope to be processed by the transfer apparatus 24, the location of the limit switch 164 is pre-set by appropriate actuation of the motor 146 before any other operation of the transfer apparatus 24 is commenced.

The actuation of limit switch 164 by the actuating member 166 on the transfer paddle assembly 120 occurs when the transfer assembly 120 has been moved to the extreme right-hand position illustrated in dashed line in FIG. 6A. At this position, the batch of envelopes is centered over the appropriate receiving apparatus, such as the envelope holding car 200 of the envelope opening machine 26 illustrated in FIG. 2. In this position, the envelopes have completely cleared the transfer channel 100 (FIG. 2) and are thus disposed entirely within the envelope holding car 200 of the envelope opening apparatus 26.

To prevent the momentum of the batch of envelopes from carrying the envelopes beyond the desired location within the envelope holding car 200, a novel, movable abutment means or bumper 440 is provided as illustrated on the right-hand side of the apparatus in FIG. 2. The bumper 440 includes a positioning mechanism, such as a pneumatically operated cylinder 441 mounted to a plate 442 on the housing 112. A piston rod 443 projects from the cylinder 441 and carries an envelope impingement plate 444.

The cylinder 441 is actuated, through a suitable control circuit in response to the actuation of the above-described limit switch 164, to move the plate 444 outwardly to the position shown in dashed lines in FIG. 2 for a preset period of time (e.g., approximately two seconds). Thus, as the transfer paddle assembly 120 terminates its movement at the extreme right-hand position illustrated in dashed line in FIG. 2, the right-hand edges of the envelopes impinge against the plate 444 so that the batch of envelopes is prevented from sliding further to the right under its own momentum. The cylinder 441 may be of the spring-retractable, single acting type, or of the double acting type. After a suitable time delay (e.g., 2 seconds), the cylinder 441 is actuated, through a suitable control system, to retract the impingement plate 444 to the position shown in solid line in FIG. 2.

When the transfer paddle assembly 120 is in the extreme right-hand position illustrated in dashed lines in FIG. 2, the clutches 426 and 428 associated with the transfer paddle apparatus drive chain 504 are both disengaged. Thus, any force acting upon the transfer paddle assembly 120, to the left or to the right, could cause the assembly 120 to undesirably move. When the bumper means 440 is actuated as discussed above to engage the right-hand end of the envelope batch, the left-hand paddle 126 of the assembly 120, being engaged with the left-hand end of the envelope batch, will receive the impact force transmitted through the envelope batch. To hold the transfer assembly 120 stationary while the impingement plate 444 is moved against the envelope batch, an electric brake 448 is provided as best illustrated in FIG. 2A.

The brake 448 is adapted to engage a shaft 450 to which the idler sprocket 508 is mounted. The brake 448 and shaft 508 are suitably mounted on a pair of cross members 452 and 454 which are in turn fixed to transverse cross members 456 and 458 between channels 130 and 132.

The brake 448 is actuated to lock the shaft 450, and hence the sprocket 508 secured thereto, against rotation when actuated by the limit switch 164 discussed above. When the bumper cylinder 441 is returned to the retracted position illustrated in solid line in FIG. 2, the brake 448 is also actuated, through a suitable control system, to release the shaft 450.

It is to be noted that the batch of envelopes is urged to the extreme right-hand position by the left-hand paddle 126. It would be desirable to provide some amount of clearance between the left-hand paddle 126 and the left-hand edge of the batch of envelopes before that batch is moved away from the transfer paddle assembly 120. This would eliminate potential interference problems. A novel switch mechanism is provided to help accomplish this as will next be explained.

With continued reference to FIG. 6A, it can be seen that the block 134 carrying the guide rollers 136 and 138 is centrally disposed on the transfer paddle assembly 120. Specifically, the mounting block 134 is located equidistant between the left-hand paddle 126 and the right-hand paddle 124 on the base plate 122.

The top of the mounting block 134 has a generally arcuate engaging surface portion 170 as best illustrated in FIG. 6A. The arcuate portion 170 is adapted to engage and actuate a limit switch 174 which is mounted, as best illustrated in FIG. 5A, to the channel 132. The limit switch 174 has an actuatable lever 176 which can be engaged by the arcuate surface portion 170 of the block 134 to actuate the switch at that point.

The switch 174 is suitably connected in the electrical control circuit for disengaging the particular clutch that drives the paddle assembly to the left as viewed in FIG. 2. However, a suitable control system is provided so that the switch 174 is not actuated when it is engaged a first time by block 134 as the assembly 120 is moved to the extreme right-hand position illustrated in solid line of FIG. 2.

After the paddle assembly 120 has been moved to the right-hand position illustrated in FIG. 2, the brake 448 is applied, the bumper means 440 is actuated and retracted as described above, and then finally the brake 448 is subsequently released. Next, the proper one of the clutches 426 and 428 is actuated to engage by the control circuit to permit the drive chain 504 to move the transfer paddle assembly 120 toward the left as viewed in FIG. 2.

The transfer paddle assembly 120 is then moved to the position illustrated in dashed lines in FIG. 2. At this point the bracket 134 again engages and actuates switch 174 as it passes from right to left as viewed in FIG. 2. This time, the switch 174, incorporated in the control circuit, initiates disengagement of the driving clutch.

In this position, the paddles 126 and 124 have moved relative to the envelope batch in the holding car 200, as best illustrated in solid line in FIG. 2, so that there is clearance on either end of the batch. This permits the envelope holding car 200 in the envelope opening apparatus 26 to easily move the envelope batch from between the paddles 124 and 126 and to the next station in the apparatus 26.

As the batch of sealed envelopes is moved by the envelope opening apparatus 26 to the next station in the opening apparatus 26, a batch of opened envelopes may be moved into alignment between the transfer paddles 124 and 126 for subsequent transfer from the envelope batch holding car 200 to the envelope infeed apparatus 20.

When a batch of opened envelopes has been appropriately positioned between the transfer paddles 124 and 126 at the right-hand end of the transfer apparatus 24, the transfer paddle assembly 120 is moved from the right to the left as viewed in FIG. 2. To this end, the appropriate one of the clutches 426 and 428 is again caused to be engaged by the control system (while the other clutch remains disengaged) so as to permit the drive chain 504 to move the transfer paddle assembly 120 toward the left.

As the assembly 120 is moved to the left, the right-hand transfer paddle 124 engages the right-hand end of the batch of opened envelopes 28 and pushes the batch of envelopes 28 against the arcuate member 110 in the guide channel 100. The envelopes ride up the arcuate member 110 and enter the guide channel 100 where they are continued to be pushed along toward the left by the paddle 124.

The envelope batch is pushed out of the left-hand end of the guide channel 100 over the arcuate member 108 into the opened envelope batch receiving cradle 150 of apparatus 20 as illustrated in FIG. 2. The movement of the transfer paddle assembly 120 is controlled at the left-hand end of its travel by means of a novel switch system similar to the switch system described above for the right-hand end of the apparatus 24 and illustrated in FIG. 6A.

Specifically, with reference to FIG. 6B, it can be seen that a limit switch mounting rod 190 is journalled for rotation between end brackets 192 and 194. The right-hand end of rod 190 carries a bevel gear 196 which is engaged with another bevel gear 198 rotatable about an axis generally perpendicular to the longitudinal axis of the rod 190. The right-hand limit switch mounting rod 140 carries a bevel gear 201 which is engaged with the bevel gear 198. Thus, rotation of the right-hand limit switch mounting rod 140 by motor 146 will cause a corresponding, but opposite rotation, of the left-hand limit switch mounting rod 190.

The left-hand limit switch mounting rod 190 has a threaded portion 204 on which is threadingly mounted a limit switch mounting block 206. As best illustrated in FIG. 5B, the longitudinally extending slot 160 of member 152 overlies the switch mounting block 206 and receives therein an upwardly projecting lug 210 mounted to the top of the switch mounting block 206. This lug 210 prevents rotation of the switch mounting block 206 on the rod threaded portion 204.

A limit switch 212 is mounted to the side of the lower portion of the switch mounting block 206 and defines a channel 214 therethrough for receiving an upstanding lug 216 of the transfer paddle 120. As best illustrated in FIGS. 5B and 6B, the limit switch 212 has a limit switch actuating member 218 projecting into the switch channel 214 for being engaged by the lug 216. This engagement occurs when the transfer paddle assembly 120 is in the extreme left-hand position illustrated in dashed lines in FIG. 6B. As with the corresponding right-hand limit switch 164 discussed above, the portion of limit switch 212 is adjustable along the length of the threaded rod portion 204 to accommodate different size envelopes.

The limit switch 212 is adjusted, simultaneously with the right hand limit switch 164 by energization of the motor 146 to properly position the limit switch 212 for operation with a particular size envelope. The settings of both limit switches 164 and 212 are necessarily simultaneously set by controlling the rotation of motor 146 as necessary. After the limit switches 164 and 212 are moved to the desired positions, the motor 146 is de-energized and remains de-energized during the subsequent batch transfer operations. The positions of the limit switches are typically adjusted when the size of the envelopes being processed changes.

As best illustrated in FIG. 5B, a stationary limit switch 220 is mounted to the side channel 132 and has a downwardly projecting L-shaped member 222 for being engaged by the arcuate portion 170 of the roller mounting block 134. As is the case with switch 174 on the right-hand side of the apparatus, the switch 220 is mounted so that it is actuated by the roller mounting block 134 when the transfer paddle assembly 120 is returning from the extreme left-hand position to the "clearance" position shown in solid line in FIG. 6B (and dashed line in FIG. 2) in which the transfer paddles 124 and 126 are spaced from the ends of the envelope batch therebetween to provide clearance on either side of the envelope batch.

The operation of the above-described switches 212 and 220 will now be described in detail. As the motor 400 drives the transfer paddle assembly 120 to the left to move the opened envelope batch from the guide channel 100 onto the infeed apparatus cradle 150, the envelope batch is engaged by the right-hand transfer paddle 124.

The transfer paddle assembly 120 is moved to the extreme left-hand position indicated in dashed lines in FIG. 6B during which movement the block 134 moves past the limit switch 220. The control system is designed so that the first engagement of the limit switch 220 by the block 134 does not have any effect on the engaged driving clutch at this time. Rather, the driving clutch is disengaged and the other clutch simultaneously engaged when the lug 216 engages the limit switch 212 at the end of the paddle assembly travel indicated by the dashed lines in FIG. 6B. This permits the motor 400 to move the chain 504 in the opposite direction (to the right, as viewed in FIG. 6B) to drive the transfer paddle assembly 120 to the clearance position illustrated in solid lines in FIG. 6B (and in dashed lines in FIG. 2).

At this point, the arcuate portion 170 of the roller mounting block 134 engages the switch 220 to disengage the then driving clutch. With both clutches 426 and 428 now disengaged, the paddle assembly remains in the clearance position. In that position, there is sufficient clearance around the ends of the batch of envelopes to permit the envelope infeed apparatus 20 to remove the envelopes with cradle 150.

The control system maintains the clutches in the disengaged state until such time as the opened envelope batch has been removed from between the transfer paddles 124 and 126 and replaced with a new batch of sealed envelopes.

After a new batch of sealed envelopes has been properly positioned between the spaced-apart paddles 124 and 126, a suitable control means, such as timer systems or control signals from an envelope infeed apparatus, re-engage the appropriate clutch again to then move the transfer paddle assembly 120 back to the extreme right-hand position (illustrated in dashed lines in FIG. 2).

When a batch of opened envelopes is transferred by the transfer device 24 from the envelope opening apparatus 26 to the receiving cradle 150 of the envelope infeed apparatus 20 illustrated in FIG. 2, it is desirable to provide an extended guide or flap 300 at the left-hand end of the guide channel 100 adjacent the cradle 150 as illustrated in FIG. 2. This flap 300 functions to properly guide the batch of envelopes into the cradle 150.

Figure 4:
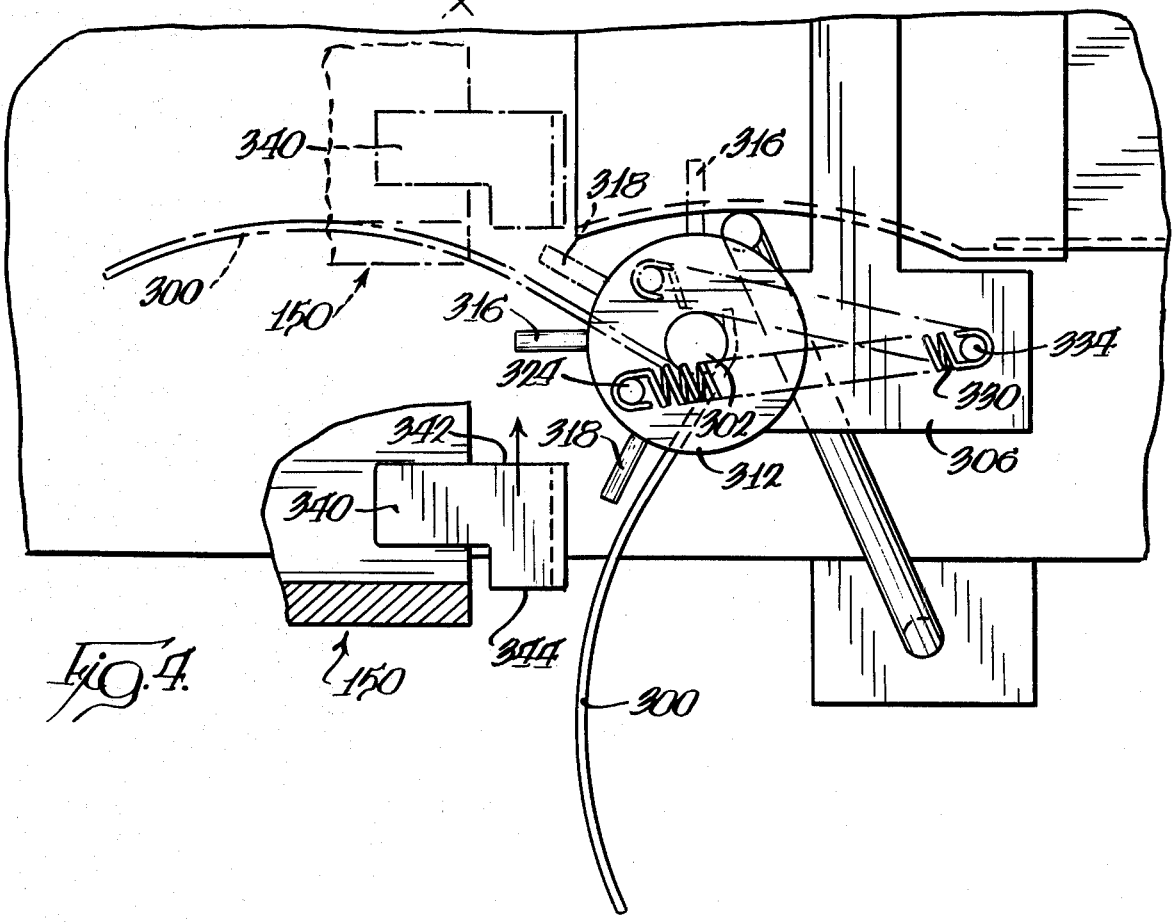
FIG. 4 is a greatly enlarged, fragmentary, partial cross-sectional view taken generally along the plane 4—4 in FIG. 3.

When the cradle 150 is swung downwardly (into the plane of the drawing in FIG. 2) in accordance with the teachings of the aforementioned concurrently filed U.S. patent application entitled, "Method and Apparatus for Feeding Envelopes," the flap 300 must be moved out of the way to permit the extending end portions of the envelopes in batch 28 to be moved downwardly. To this end, the flap 300 is pivotably mounted as best illustrated in FIGS. 3 and 4. (The flap 300 does not have to be pivoted out of the way when a batch of *sealed* envelopes is presented to the transfer apparatus 24 because the sealed envelope batch infeed car of infeed device 20 is moved into position on a track in a plane parallel to the walls 104 and 106 of channel guide 100 as described in the aforementioned patent application entitled "Method and Apparatus for Feeding Envelopes," Ser. No. 135,354.)

FIG. 3 shows the flap 300 mounted to a shaft 302 with the flap being oriented in a downwardly extended position. The downward orientation is more clearly illustrated in solid line in FIG. 4. The horizontal or "up" position is illustrated in FIG. 4 in dashed line. It is to be noted that FIG. 2 shows the flap in the "up" position.

The shaft 302 is mounted at one end with a channel 304 to the rear channel 130 of the main housing 112. The shaft 302 is journalled for rotation at the one end in the channel 304 and at the other end in a T-shaped plate 306 secured to the bottom floor 102 of the guide channel 100.

Secured to the distal end of the shaft 302 is a disc member 312 to which is mounted a pair of outwardly projecting prongs 316 and 318. The disc 312 also carries a pin 324 which projects outwardly from the disc 312 substantially parallel to the longitudinal axis of the shaft 302.

A spring 330 is secured on one end to the pin 324 and is secured at the other end to a mounting pin 334 which is carried by the T-shaped mounting plate 306. The location of the pins 324 and 334 are chosen relative to the shaft 302 to effect an over-center movement.

As best illustrated in FIGS. 2, 3, and 4, the receiving cradle 150 of the infeed apparatus 20 is provided with an actuating bracket 340 having a forward leading edge 342 and a rearward edge 344. When the receiving cradle 150 is moved upwardly into position adjacent the guide channel 100 as shown in solid line in FIG. 2, the leading edge 342 (FIG. 4) moves against the pin 316 on the disc 312. This causes the disc 312 to rotate in the clockwise direction as viewed in FIG. 4.

The receiving cradle 150 is brought to rest (by suitable mechanisms on the infeed apparatus 20 as described concurrently filed patent application entitled "Method and Apparatus for Feeding Envelopes") at the position illustrated in dashed line in FIG. 4. In this position, the disc 312, shaft 302, and flap 300 have been rotated to the position illustrated in dashed line in FIG. 4 and is held in that position by the overcenter action of the spring 330. When the leading edge 342 of the bracket 340 engages the pin 316 and rotates the disc 312 in the clockwise direction to the position illustrated in dashed lines in FIG. 4, the flap 300 is necessarily moved to the extended or "up" position to provide a guide surface between the guide channel 100 and the opened envelope receiving cradle assembly 150 as illustrated in FIG. 2.

After the batch of opened envelopes has been properly positioned within the receiving cradle 150 as illustrated in FIG. 2, the receiving cradle 150 is swung downwardly, whereupon the rearward edge 344 of the bracket 340 engages the pin 318 and returns the extension flap 300 to the retracted or "down" position permitting the extending edges of the envelopes to move past the flap without interference.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims, all such modifications as fall within the scope of the claims.

What is claimed is:

1. A method for transferring a first batch of envelopes from a first station adapted to receive movable pairs of first station spaced-apart holding members to a second station adapted to receive movable pairs of second station spaced-apart holding members and for subsequently transferring a second batch of envelopes from said second station to said first station; each said envelope having first and second opposite end edges, a bottom edge, and a top edge; said method comprising the steps of:

(a) providing and aligning a guide to extend between said first and second stations, said guide having a guide surface for guiding at least the bottom edges of the envelopes;

(b) providing a transfer assembly having first and second paddles spaced apart by an amount greater than the length of said envelopes and locating said transfer assembly at said first station;

(c) arranging a plurality of said envelopes in face-to-face relationship to form said first batch with said first end edges of said envelopes being disposed substantially at and defining a first end of said first batch and with said second end edges being disposed substantially at and defining a second end of said first batch;

(d) positioning a first pair of said first station holding members at said first station and placing said first batch of envelopes at said first station between said first pair of first station holding members with the upper portions of said envelopes that define said top edges projecting beyond said first station holding members and with the batch being located between said transfer assembly first and second paddles;

(e) positioning a first pair of said second station holding members at said second station;

(f) moving said transfer assembly in a first direction to contact the projecting upper portions of said envelopes at said first batch first end with said first paddle and to push said first batch in said first direction out of said first station, along said guide surface, and into said second station between said first pair of second station holding members;

(g) terminating the movement of said transfer assembly in step (f) when said first batch is positioned between said first pair of second station holding members;

(h) moving said transfer assembly in a second direction opposite to said first direction an amount to space said first paddle away from said first end of said first batch while maintaining a space between said second end of said first batch and said second paddle;

(i) moving said first pair of second station holding members to remove said first batch from said second station;

(j) arranging a plurality of said envelopes in face-to-face relationship to form said second batch of envelopes with the first end edges of said envelopes being disposed substantially at and defining a first end of said second batch and with said second end edges of said envelopes being disposed substantially at and defining a second end of said second batch;

(k) positioning a second pair of said second station holding members at said second station and placing said second batch of envelopes at said second station between said second pair of second station holding members with the upper portions of said envelopes that define said top edges projecting beyond said second pair of second station holding members and with the second batch being located between said transfer assembly first and second paddles;

(l) removing said first pair of first station holding members from said first station and positioning a second pair of first station holding members at said first station;

(m) moving said transfer assembly in said second direction to contact the projecting upper portions of said envelopes at said second batch second end with said second paddle and to push said second batch in said second direction out of said second station, along said guide surface, and into said first station between said second pair of first station holding members;

(n) terminating the movement of said transfer assembly in step (m) when said second batch is positioned between said second pair of first station holding members; and (o) moving said transfer assembly in said first direction an amount sufficient to provide clearance between said second paddle and said second end of said second batch while maintaining clearance between said first paddle and said first end of said second batch.

2. A method for transferring a first batch of envelopes from a first station to a second station and for subsequently transferring a second batch of envelopes from said second station to said first station; each said envelope having first and second opposite end edges, a bottom edge, and a top edge; said method comprising the steps of:

(a) providing and aligning a guide to extend between said first and second stations to guide said envelopes;

(b) providing a transfer assembly having first and second paddles spaced apart by an amount greater than the length of said envelopes and locating said transfer assembly at said first station;

(c) arranging a plurality of said envelopes in face-to-face relationship to form a first batch with said first end edges of said envelopes being disposed substantially at and defining a first end of said first batch and with said second end edges of said envelopes being disposed substantially at and defining a second end of said first batch;

(d) holding said first batch of envelopes between spaced-apart holding members at said first station with the upper portions of said envelopes that define said top edges projecting beyond the holding members at said first station and with the batch being located between said transfer assembly first and second paddles;

(e) moving said transfer assembly in a first direction to contact the projecting upper portions of said envelopes at said first batch first end with said first paddle and to push said first batch in said first direction out of said first station, along said guide, and between spaced-apart holding members at said second station;

(f) removing said first batch of envelopes from said second station;

arranging a plurality of said envelopes in face-to-face relationship to form a second batch of envelopes with the first end edges of said envelopes being disposed substantially at and defining a first end of said second batch and with said second end edges of said envelopes being disposed substantially at and defining a second end of said second batch;

(h) holding said second batch of envelopes between spaced-apart holding members at said second station with the upper portions of said envelopes that define said top edges projecting beyond said holding members at said second station and with said second batch being located between said transfer assembly first and second paddles; and (i) moving said transfer assembly in a second direction opposite to said first direction to contact the projecting upper portions of said envelopes at said second batch second end with said second paddle and to push said second batch in said second direction out of said second station, along said guide, and into said first station between spaced-apart holding members at said first station.

3. The method in accordance with claim 2 in which steps (d) and (h) include orienting each batch of envelopes between the spaced-apart holding members at each station with the outer envelopes of each batch being positioned adjacent one of said holding members.

4. The method in accordance with claim 2 in which steps (e) and (i) include moving said envelopes along said guide with said bottom edges of said envelopes in contact with said guide.

5. A method for transferring envelopes from a first station to a second station and for subsequently transferring envelopes from said second station to said first station wherein each said envelope has first and second opposite end edges, a bottom edge, and a top edge; said method comprising the steps of:

(a) providing and aligning a guide to extend between said first and second stations to guide said envelopes;

(b) providing first and second paddles spaced apart by an amount greater than the length of said envelopes and locating said paddles at said first station;

(c) arranging a plurality of said envelopes in face-to-face relationship to form a first batch with said first end edges of said envelopes being disposed substantially at and defining a first end of said first batch and with said second end edges of said envelopes being disposed substantially at and defining a second end of said first batch;

(d) holding said first batch of envelopes between two spaced-apart holding members at said first station with the batch being located between said first and second paddles;

(e) moving said first and second paddles together in a first direction to contact said first batch first end with said first paddle and to push said first batch in said first direction out of said first station, along said guide, and between two spaced-apart holding members at said second station;

(f) removing said first batch of envelopes from said second station;

(g) arranging a plurality of said envelopes in face-to-face relationship to form a second batch of envelopes with the first end edges of said envelopes being disposed substantially at and defining a first end of said second batch and with said second end edges of said envelopes being disposed substantially at and defining a second end of said second batch;

(h) holding said second batch of envelopes between two spaced-apart holding members at said second station with said second batch being located between said first and second paddles; and (i) moving said first and second paddles together in a second direction opposite to said first direction to contact said second batch second end with said second paddle and to push said second batch in said second direction out of said second station, along said guide, and into said first station between spaced-apart holding members at said first station.

6. The method in accordance with claim 5 in which said second batch is the same batch as said first batch.

7. Apparatus for (1) transferring a first batch of envelopes from a first station adapted to receive movable pairs of spaced-apart holding members to a second station adapted to receive movable pairs of spaced-apart holding members and (2) subsequently transferring a second batch of envelopes from said second station to said first station; each said envelope having first and second opposite end edges, a bottom edge, and a top edge; said apparatus comprising:

(a) a support housing;

(b) a guide supported from said housing for extending between said first and second stations for guiding said envelopes;

(c) a transfer assembly having outwardly projecting first and second paddles spaced apart by an amount greater than the length of said envelopes, each said paddle terminating short of said holding members at said first and second stations to permit movement of said paddles therepast;

(d) means for mounting said transfer assembly on said housing for movement relative to said first and second stations;

(e) means for positioning said transfer assembly at said first station where (1) a plurality of envelopes may be arranged in face-to-face relationship to form said first batch with said envelope first end edges being disposed substantially at and defining a first end of said first batch and with said envelope second end edges being disposed substantially at and defining a second end of said first batch and (2) said first batch may be placed between said transfer assembly first and second paddles and held between a first pair of spaced-apart first station holding members with a portion of each envelope in the batch projecting beyond the holding members;

(f) means for moving said transfer assembly in a first direction from said first station to contact said first batch first end with said transfer assembly first paddle to push said first batch out of said first station, along said guide, and between a first pair of second station holding members at said second station from which said second station holding members may be subsequently moved for removing said first batch and to which second station a second pair of second station holding members may be moved for receiving a plurality of envelopes arranged in face-to-face relationship to form said second batch of envelopes with the first end edges of said envelopes being disposed substantially at and defining a first end of said second batch, with said second end edges of said envelopes being disposed substantially at and defining a second end of said second batch, and with a portion of each envelope in the batch projecting beyond the holding members; and (g) means for moving said transfer assembly in a second direction opposite to said first direction to contact said second batch second end with said transfer assembly second paddle to push said second batch out of said first station, along said guide, and between a second pair of first station holding members at said first station.

8. The apparatus in accordance with claim 7 in which said means for mounting said transfer assembly includes a guide member mounted to said housing, in which said transfer assembly is slidably disposed on said guide member, and in which said means for positioning and said means for moving said transfer assembly in said first and second directions all together include (1) a length of chain having a first end secured to said transfer assembly and having a second end secured to said transfer assembly, said chain being disposed around at least two spaced-apart sprockets, and (2) means for driving said chain in either of two directions to move said transfer assembly between said first and second stations.

9. The apparatus in accordance with claim 7 in which said apparatus further includes a pneumatically operated cylinder mounted to said housing at said second station, said cylinder including a piston rod carrying an envelope impingement plate for contacting the second end of said first batch and for moving said first batch in said second direction to a predetermined location at said second station.

10. The apparatus in accordance with claim 7 in which said guide has a bottom wall and a pair of opposed sidewalls that cooperate to define a channel-shaped configuration.

11. The apparatus in accordance with claim 10 in which said bottom wall has a central straight portion and an arcuate portion at each end.

12. The apparatus in accordance with claim 7 including a shaft mounted to said guide for rotation about an axis generally normal to said straight portion of the bottom wall of the guide, said shaft carrying two outwardly projecting prongs and an arcuate flap for guiding envelopes, each said prong being adapted to be engaged to rotate said shaft, and said apparatus further including a tension spring connected at one end to said guide and at the other end to said shaft but offset from the longitudinal axis of said shaft to effect an over-center biasing of the shaft in either of two orientations.

13. A method for transferring envelopes from a first station to a second station and for subsequently transferring envelopes from said second station to said first station wherein each said envelope has first and second opposite end edges, a bottom edge, and a top edge; said method comprising the steps of:

(a) providing and aligning a guide to extend between said first and second stations to guide said envelopes;

(b) providing first and second paddles spaced apart by an amount greater than the length of said envelopes and locating said paddles at said first station;

(c) holding a batch of envelopes between two spaced-apart holding members at said first station with the batch being located between said first and second paddles with the envelopes in face-to-face relationship with said first end edges of said envelopes being disposed substantially at and defining a first end of the batch and with said second end edges of said envelopes being disposed substantially at and defining a second end of the batch;

(d) moving said first and second paddles together in a first direction to contact said batch first end with said first paddle and to push said batch in said first direction out of said first station, along said guide, and at least into said second station;

(e) holding a batch of envelopes between two spaced-apart holding members at said second station with the batch being located between said first and second paddles with the envelopes in face-to-face relationship with the first end edges of said envelopes being disposed substantially at and defining a first end of the batch and with said second end edges of said envelopes being disposed substantially at and defining a second end of the batch; and (f) moving said first and second paddles together in a second direction opposite to said first direction to contact the second end of the batch at said second station with said second paddle and to push the batch in said second direction out of said second station, along said guide, and into said first station between spaced-apart holding members at said first station.

* * * * *